US005087095A

United States Patent [19]

McFate

[11] Patent Number: 5,087,095

[45] Date of Patent: Feb. 11, 1992

[54] RECREATIONAL CHAIR

[76] Inventor: Richard A. McFate, 537 Winthrop Rd., Collegeville, Pa. 19426

[21] Appl. No.: 554,440

[22] Filed: Jul. 19, 1990

[51] Int. Cl.[5] ..... A47C 5/10; A45F 4/02

[52] U.S. Cl. ..... 297/129; 297/217; 224/155

[58] Field of Search ..... 297/17, 118, 129, 183, 297/191, 217; 224/154, 155

[56] References Cited

U.S. PATENT DOCUMENTS 2,811,977 11/1957 McClish ..... 297/184
3,151,909 10/1964 Gerdetz ..... 224/155 X
4,466,517 8/1984 Spiegelman ..... 5/419 X
4,470,630 9/1984 Shields ..... 297/118
4,487,345 12/1984 Pierce et al. ..... 224/155
4,546,507 10/1985 Weinstein ..... 5/419
4,676,548 6/1987 Bradbury ..... 297/129
4,687,248 8/1987 Ross et al. ..... 297/129

*Primary Examiner*—Peter R. Brown
*Attorney, Agent, or Firm*—Joseph W. Molasky & Assocs. Molasky

[57] ABSTRACT

A recreational chair for use in a beach environment. The chair is accompanied by certain attachments that are useful for sunning on a sandy surface. Attachments are also provided for allowing easy transport of the chair upon the back of the user.

22 Claims, 2 Drawing Sheets

RECREATIONAL CHAIR

BACKGROUND OF THE INVENTION

This invention relates in general to a chair and, in particular, to a beach chair that incorporates various expedients for storing, reclining and transporting from location to location.

It is customary when a family or even an individual spends a day at the beach that a variety of items such as towels, suntanning lotions, sunscreens, insect repellants, sunburn lotions, ointments and blankets must be carried along in order to satisfy various needs. When a beach chair is carried in addition to the above-cited items, it is clear that the task is burdensome especially if the individual or family is accompanied by small children who are constantly under surveillance.

The present invention has been designed to overcome the shortcomings of the prior beach chair art. This is attained by various expedients which are incorporated into the chair of this invention for allowing its facile transport and for storing the plurality of items in discrete pockets.

The chair of this invention is also equipped with a self contained spreadable unit that serves as a blanket for lying upon sand or similar type soil.

SUMMARY OF THE INVENTION

The chair of this invention is a low styled product that finds particular use upon a sandy beach surface.

Located upon the back of the chair are a plurality of discrete pockets for storing various items that are necessary and useful when spending time at the beach.

A pocket is also provided for storing a length of protective covering that may be used for reclining in the sun in the vicinity of the chair.

In addition, slings are attached to the chair to allow it to be easily transported from place to place upon the user's back without using one's hands.

Accordingly, it is an object of this invention to provide a new and improved chair suited particularly for recreational purposes.

It is still a further object of the invention to provide a recreational chair that is versatile in its usage.

DESCRIPTION OF THE PREFERRED EMBODIMENT

Figure 1:
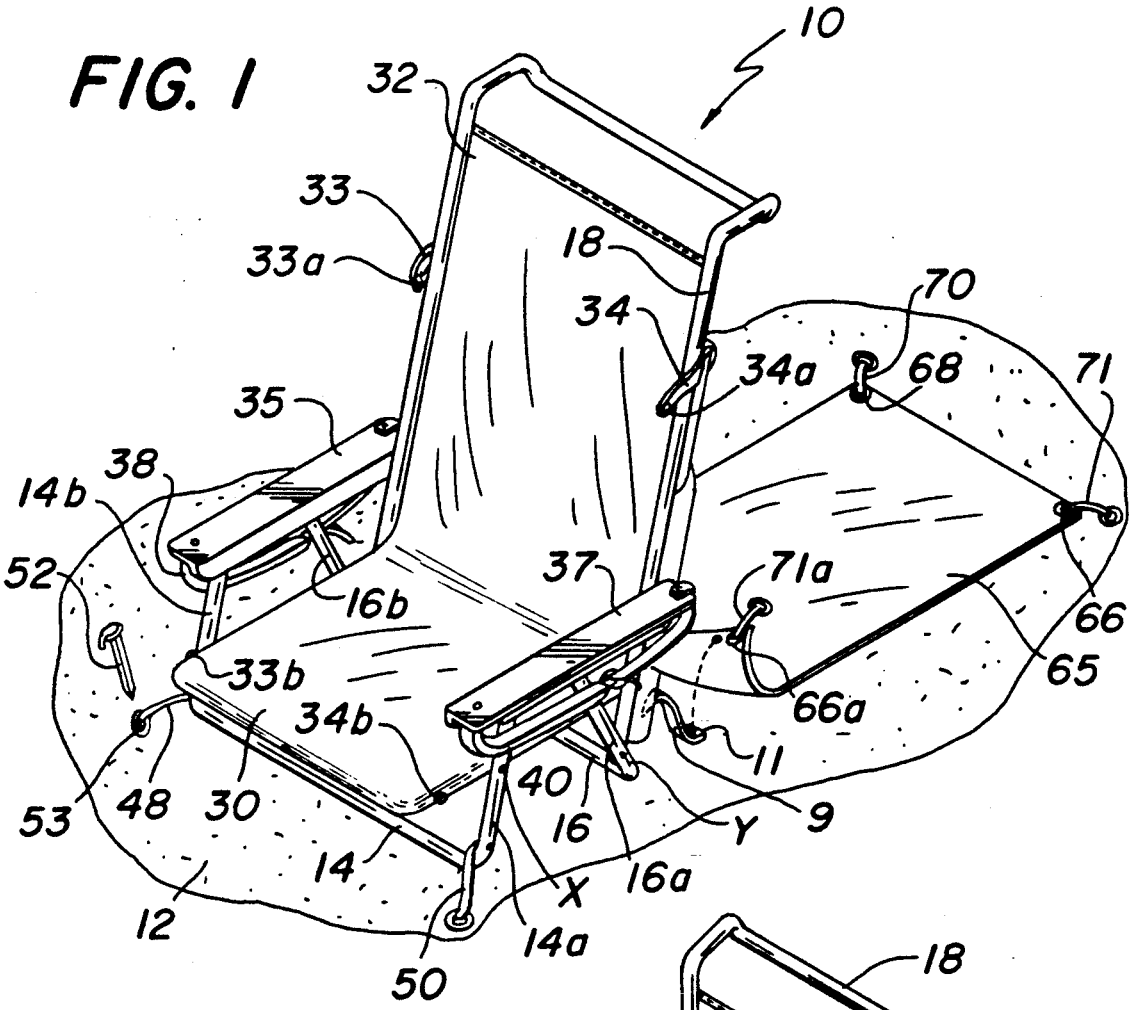
FIG. 1 is a perspective view of the recreational chair of the invention.

Referring to the drawings and in particular to FIG. 1, there is depicted the low styled recreational chair 10 of the invention in a perspective view. Chair 10 is basically constructed from thin tubing 18 that is bent to form the framing for the various component parts. The chair 10 is designed for recreational use upon a sandy surface 12 as at a beach environment, and as such includes short front and rear leg supports 14, 14*a*, 16, 16*a* to provide a comfortable sitting position for the user. This position allows for full extension of the legs to obtain proper sunning and tanning.

Figure 4:
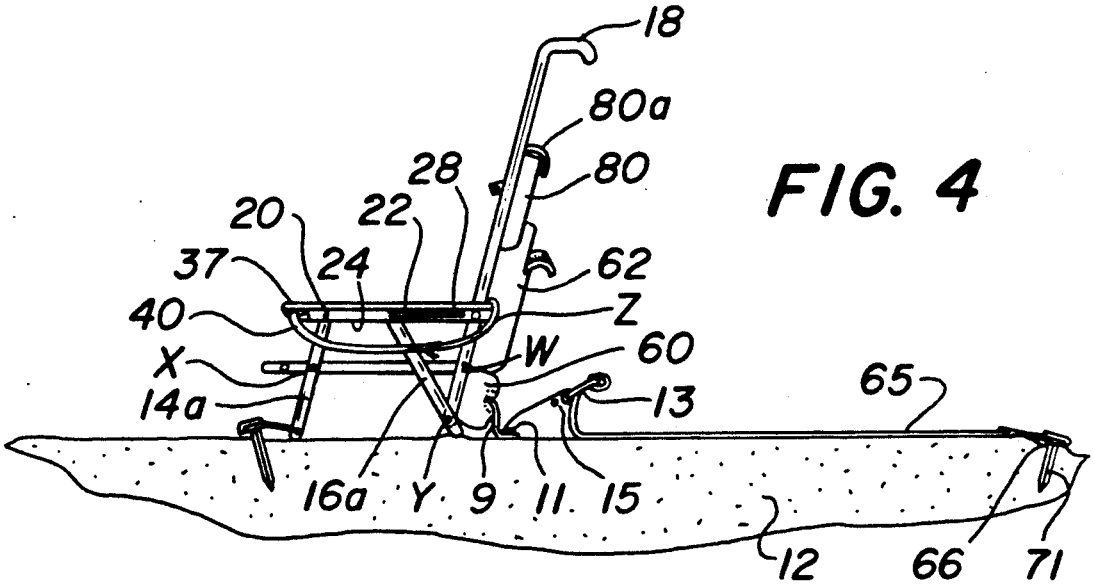
FIG. 4 is a side view of the beach chair depicting the various pockets, one of which retains a protective covering for resting on the beach in the vicinity of the chair.

The front and rear leg supports 14, 16 which are angled upwardly to furnish the supporting structure 14*a*, 16*a* and 14*b*, 16*b* include slidable pivot points 20, 22 (see FIG. 4). The pivots 20, 22 are provided in an arm support member 24; similar structural elements are furnished in an oppositely positioned arm support (not shown). The pivot point 22 is slidable in slot 28 formed in support members 24 when the chair 10 is collapsed into a thin profile condition for purposes of transporting or storage. Additional non-slidable pivot points w, x, y, z are also provided for folding up the chair in the thin profile position. As understood, corresponding pivot points are located in the opposite arm and leg supports of the chair (not shown).

The tubing 18 of the chair 10 is also formed into the framing for a seat 30 and back rest 32. Attached to the framing of the back rest by a rivet or the like are straps 33, 34, which incorporate female connectors 33*a*, 34*a* for joining to the male connectors 33*b*, 34*b*. Mating male connectors 33*b*, 34*b* are fixedly positioned upon the pipe framing 18 which forms the outline of the seat 30. The connectors and straps are employed to keep the chair 10 in a semi-permanent thin profile condition when being transported from place to place or when placed in storage.

A suitable fabric such as canvas, vinyl or polyester is stretched across the framing 18 with respect to the back rest 32 and seat 30 of the chair 10 to furnish a suitable support structure. Arm rests 35, 37 in the form of flat surfaces made of wood or other suitable material are respectively attached to support member 24 as well as to the corresponding opposite member. The arm rests are joined to the underlying support members by appropriate fasteners.

Figure 2:
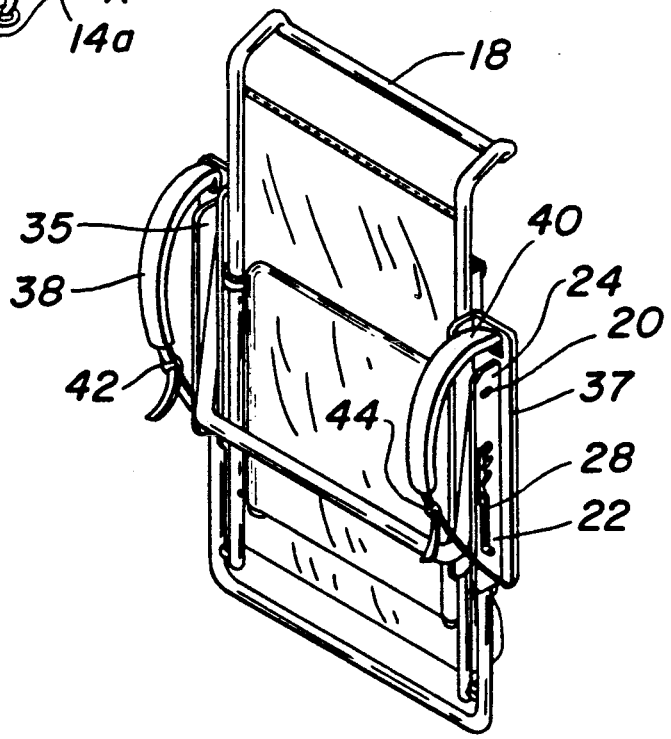
FIG. 2 is a view of the chair which is folded into a flat profile together with slings for transporting from place to place.

Located under the arm rests 35, 37 and in the respective supports are slings 38, 40, which are adjustable by way of suitable buckling devices 42, 44 as may be seen in FIG. 2. FIG. 2 illustrates the chair 10 in a folded-up or flat profile status and illustrate the relationship of the slings with respect to the underside of the arm rests 35, 37 and their respective support members. The straps 38, 40 are employed for placing the chair 10 over the user's arms and across the back so that it can be easily carried without use of the hands. This leaves the hands of the user free to carry large and bulky items which conventionally accompany an individual to the beach such as thermos bottles, picnic baskets or for holding the hands of small children. The buckling devices 42, 44 allow the slings to be adjusted according to the physical dimensions of the carrier so that it is comfortable and snug.

The chair 10 is also equipped with additional straps 48, 50 (see FIG. 1) which extend from the vertical supports 14*a*, 14*b* and are utilized to semi-permanently fix the beach chair 12 to the sandy surface or beach 12. Each strap terminates in an eyelet 53 that is adapted to receive a stake 52 for penetrating the beach surface 12. An identical stake (not shown) is also driven through an eyelet located at the end of strap 50. This expedient allows the chair 10 to remain fixed in position on windy days which are prevalent particularly on ocean beaches.

Figure 3:
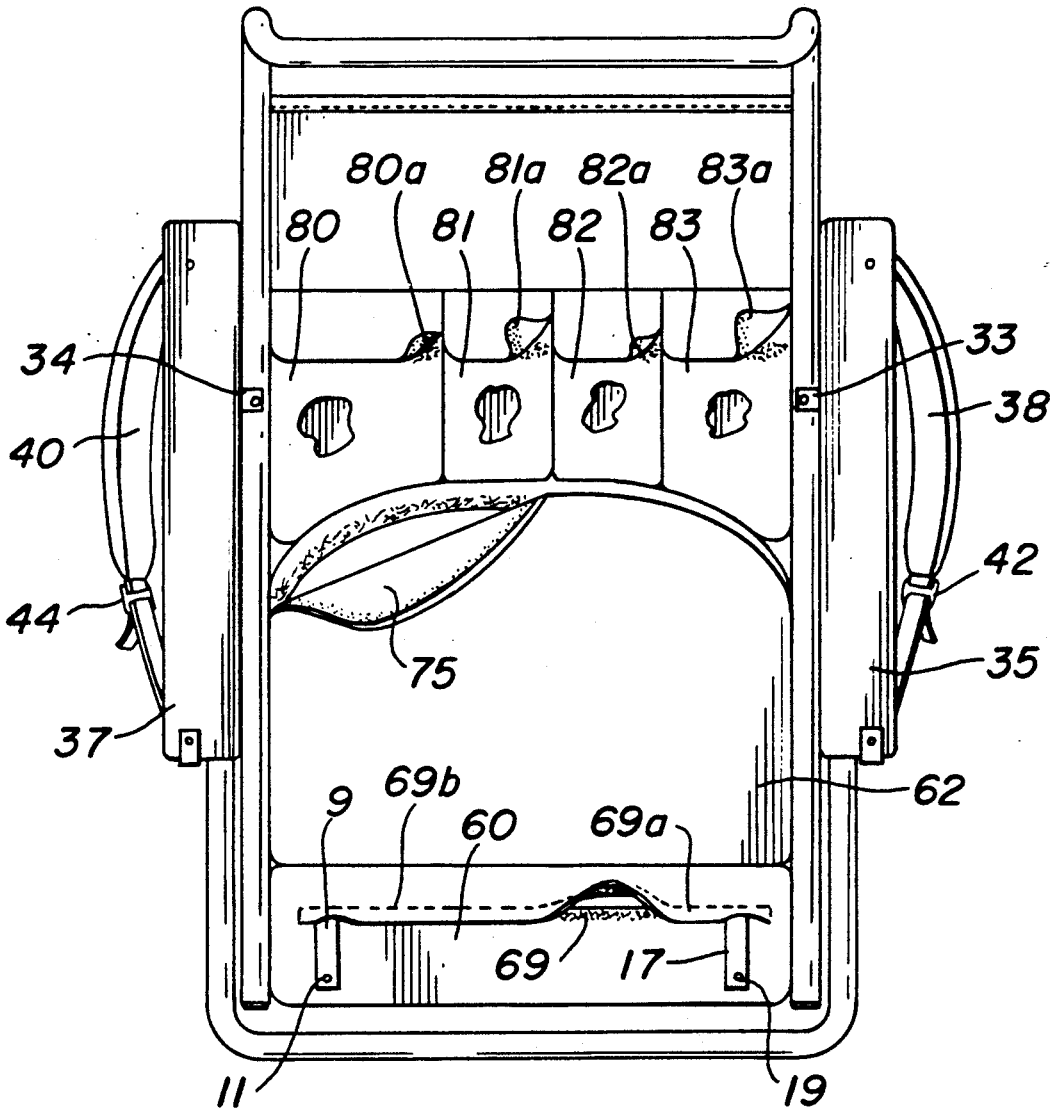
FIG. 3 is a view of the rear of the chair illustrating a plurality of pockets for carrying various items.

Referring to FIG. 3, there is presented a view of the rear of the chair 10 when it is in the flat profile condition. The back of the chair is provided with numerous and various sized pockets for storing and holding a variety of items that are useful when a family or individual is at the shore or similar surroundings, but removed a distance from a business area. One of the pockets is a closable pouch 60 located along the bottom of the chair 10 for storing a length of foldable material or tarp 65 (see FIGS. 1, 4) suitable for placing upon a beach surface for the purpose of lying thereon. The tarp 65 may comprise any suitable material such as lightweight canvas or the like that is easily foldable into the pouch 60 when not in use. A length of tarp 65 of approximately six to seven feet is utilized in order to accommodate either a male or female body when lying full length thereon. Four apertures or eyelets 66, 66*a*, 68 and one that is not visible are provided at the ends of the foldable material 65 for receiving respective stakes 70, 71, 71*a* and one that is not shown which will maintain the tarp in a fixed position during breezy and windy time periods. Straps 9, 17, which include respective connector buttons 11, 19, are fixedly located within the pouch 60 and are utilized to maintain the tarp 65 in a position upon the beach surface 12, to provide additional hold down support for the chair 10 and to secure the tarp within the pouch 60. The tarp 65 is approximately connected via mating button 15 to the button 11 of the strap 9 (See FIG. 1) for the above stated reasons. A mating button is also provided on the opposite side of button 15 for connecting with fastener button 19 but is not shown. The tarp 65 may also be permanently fixed within the pouch 60 in accordance with the skill of the art and thereby eliminating the need for straps 9, 17. The eyelet 66*a* located next to the button fastener 15 in combination with the spike 71*a* provides additional hold down support for the rear of the chair 10 and the tarp 65. The same hold down structure is provided on the opposite rear side of the chair. As understood, the tarp 65 may be separated from the pouch and placed in another area in accordance with the desires of the user.

The foldable tarp 65 increases the versatility of the chair 10 by allowing the user either to sit upon seat 30 with the accompanying back rest 32 for reading, resting or observing, or to prostrate oneself upon the tarp 65 to receive the sun's rays over the entire body. When the user up and easily stored in the pouch 60 by an optional utilization of the mating buttons 11, 15 as previously discussed. A VELCRO fastener 69 (see FIG. 3) comprising appropriate male and female components is provided at the opening of the pouch 60 for sealing and closing purposes. The fastener 69 has a configuration of a flap 69*a* that overlaps the opening 69 for attaining proper closing and sealing of the pouch 60.

Positioned above the pouch 60 is a pocket 62 which is suitable for receiving large items such as towels, newspapers, magazines and small beverage bottles. The pocket 62 includes a VELCRO fastener 75 for purposes of easy opening and closing of the unit. Furthermore, the pocket 62 has a wide upwardly facing opening to allow for easy entry and removal of the above-mentioned large items. As understood, the VELCRO fastener 75 provides a male and female component upon the respective inner lips of the opening to allow for proper closing.

A plurality of smaller and individualized pockets 80, 81, 82 and 83 are oriented above the large pocket 62. These pockets are intended to be utilized by an individual or family for specific items such as cameras, lotions, keys, sunglasses and tissues. These items may be so identified on the respective pockets so that the user may easily compartmentalize the various units when not in use.

Each of the pockets includes a closing arrangement in the form of VELCRO fasteners 80*a*, 81*a*, 82*a* and 83*a* which are similar in scope and operation to the fastener 69 of pouch 60. Therefore, each one of the fasteners includes a flap for covering an opening.

The mechanism of the chair 10 including pivots and slots required to fold it into the thin profile condition as shown in FIGS. 2, 3 may be easily modified in accordance with folding beach chairs that are commercially available. The substitution of these commercial hinging mechanisms do not enhance the invention as disclosed herein and claimed below.

In summary, the present invention is directed to a recreational chair for particular use at the beach that is easily transportable by hand or by draping over the back of the carrier with appropriately located slings. The chair employs additional pouches and pockets for storing a length of material that is suitable for lying thereon to obtain full sun, as well as for providing capacity to hold necessary items pertinent for spending a day at the beach.

The chair is further characterized by the use of fasteners that maintain the chair in a folded-up profile for ease of storing and transporting. Straps and stakes are also provided for maintaining the chair and the length of material in a relatively stable condition in a windy environment.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A recreational chair comprising:

(a) a lightweight foldable framing means which provides a support for a seat, backrest, arm supports and legs for said chair, said framing means being covered with a material along said seat and backrest to allow for comfortable seating in said chair;

(b) said framing means being foldable into a relatively flat profile for transporting and storage purposes;

(c) a flat means positioned on respective arm supports for placement of an occupant's arms and elbows when using said chair;

(d) means fastened to each end of said respective flat means and support to allow for easy carrying of said chair upon the back and across the shoulders of the user when said chair is folded in the flat profile condition; and (e) said carrying means being adjustable to fit the shoulder and width dimensions of the carrier; whereby said carrying means frees the hands of the user for carrying additional items associated with the recreational use of said chair.

2. A recreational chair in accordance with claim 1 wherein said adjustable carrying means comprises a strap means located under said flat means and arm supports.

3. A recreational chair in accordance with claim 1 and further comprising a foldable means being joinable to the back rest of said chair, said foldable means being extendable a distance from said chair to serve as a protective surface for lying thereon.

4. A recreational chair in accordance with claim 3 wherein said foldable means is joined to said back rest by strap means.

5. A recreational chair in accordance with claim 3 wherein said foldable means is storable in a closable pouch means when not in use.

6. A recreational chair in accordance with claim 5 and further comprising four fastening means positioned upon said foldable means to prevent movement when placed in a windy environment.

7. A recreational chair in accordance with claim 6 wherein at least two said fastening means are connected to respective strap means of said backrest.

8. A recreational chair in accordance with claim 5 and further comprising a closable pocket positioned above said pouch means and on the back of said chair, said pocket being generally utilized to store large items.

9. A recreational chair in accordance with claim 8 and further comprising a plurality of relatively small and closable pockets located on the back of said chair and above said large pocket for storing various small items.

10. A recreational chair in accordance with claim 9 and further comprising means for attachment to at least two of said legs to a surface upon which said chair rests to prevent movement when placed in a windy environment.

11. A recreational chair in accordance with claim 10 and further comprising fastening means located upon the backrest and seat of said chair for locking said chair when in said flat profile position to assure easy transport of said chair.

12. A recreational chair comprising:

(a) lightweight foldable framing means which provides a support for a seat, backrest, arm supports and legs for said chair, said framing means being covered with a material along said seat and backrest to allow for comfortable seating in said chair;

(b) said framing means being foldable into a relatively flat profile for transporting and storage purposes;

(c) a flat means positioned on respective arm supports for placement of an occupant's arms and elbows when using said chair;

(d) carrying means fastened to each end of said flat means to form a sling for carrying said chair upon the back of the user when said chair is folded in the flat profile condition; and (e) foldable means connected in the vicinity of the backrest of said chair wherein said foldable means is extendable a distance from said chair to serve as a protective surface for lying thereon.

13. A recreational chair in accordance with claim 12 and further comprising a pouch means located upon the rear surface of said backrest for storing said foldable means when not in use.

14. A recreational chair in accordance with claim 13 wherein said foldable means may be attached, or alternatively detached to the backrest of said chair.

15. A recreational chair in accordance with claim 13 and further comprising a pocket means located upon the rear surface of said backrest above said pouch means for storing relatively large items.

16. A recreational chair in accordance with claim 15 and further comprising a plurality of contiguously positioned small pockets located upon the rear surface of said backrest above said pocket means.

17. A recreational chair in accordance with claim 12 and further including attaching means for fixing said foldable means to a relatively flat surface.

18. A recreational chair in accordance with claim 17 and further including attaching means for fixing said chair to said relatively flat surface.

19. A recreational chair in accordance with claim 12 and further including adjustable means located under said flat means for transporting said chair from place-to-place when said chair framing assumes said flat profile.

20. A recreational chair comprising:

(a) lightweight foldable framing means which provides a support for a seat, backrest, arm supports and legs for said chair,m said framing means being covered with a material along said seat and backrest to allow for comfortable seating in said chair;

(b) said framing means being foldable into a relatively flat profile for transporting and storage purposes;

(c) a flat means positioned on respective arm supports for placement of an occupant's arms and elbows when using said chair;

(d) carrying sling means permanently affixed to each end of said flat means to provide permanent means of carrying said chair when in its folded position, and (e) at least one pocket means located upon the back of said chair for storing various items.

21. A recreational chair in accordance with claim 20 and further including a plurality of pocket means positioned above said single pocket means.

22. A recreational chair in accordance with claim 20 and further including an adjustable strap means for said sling means for adjusting the length of said sling means to suit the comfort of a user when said chair framing means assumes said flat profile.

* * * * *